US010994166B2

(12) United States Patent
Parent et al.

(10) Patent No.: US 10,994,166 B2
(45) Date of Patent: May 4, 2021

(54) TRANSITION TRAMPOLINE BED

(71) Applicants: James Parent, Mount Pleasant, MI (US); Bill Duddles, Mount Pleasant, MI (US); Carrie Spender, Mount Pleasant, MI (US)

(72) Inventors: James Parent, Mount Pleasant, MI (US); Bill Duddles, Mount Pleasant, MI (US); Carrie Spender, Mount Pleasant, MI (US)

( * ) Notice: Subject to any disclaimer, the term of this patent is extended or adjusted under 35 U.S.C. 154(b) by 47 days.

(21) Appl. No.: 16/521,062

(22) Filed: Jul. 24, 2019

(65) Prior Publication Data

US 2020/0030654 A1 Jan. 30, 2020

Related U.S. Application Data

(60) Provisional application No. 62/702,638, filed on Jul. 24, 2018.

(51) Int. Cl.

| | |
|---|---|
| ***A63B 6/00*** | (2006.01) |
| ***A63B 5/11*** | (2006.01) |
| ***A63B 21/04*** | (2006.01) |
| ***A63B 21/16*** | (2006.01) |
| *A63B 71/06* | (2006.01) |

(52) U.S. Cl.

CPC ..... *A63B 6/00* (2013.01); *A63B 5/11* (2013.01); *A63B 21/0414* (2013.01); *A63B 21/16* (2013.01); *A63B 2071/0694* (2013.01); *A63B 2210/50* (2013.01)

(58) Field of Classification Search

CPC ..... A63B 5/11; A63B 21/0414; A63B 5/08–2005/085; A63B 6/00–6/02; A63B 2209/10

See application file for complete search history.

(56) References Cited

U.S. PATENT DOCUMENTS

| | | | | |
|---|---|---|---|---|
| 2007/0004560 | A1* | 1/2007 | Nelson | A63B 5/11 482/29 |
| 2015/0360067 | A1* | 12/2015 | Davis | A63B 5/11 482/27 |
| 2016/0256722 | A1* | 9/2016 | Tsai | A63B 5/11 |
| 2019/0126121 | A1* | 5/2019 | Ramaswamy | A63B 21/4037 |
| 2020/0029716 | A1* | 1/2020 | Guillot | A47C 9/002 |

OTHER PUBLICATIONS

Tumbl Trak Document (derived from: Tumbl Trak, "Xtreme Tumbl Trak" [online], Jun. 28, 2017 [retrieved on: Dec. 3, 2020], Tumbl Trak, Retrieved from: https://web.archive.org/web/20170628161008/http://www.tumbltrak.com/product/0:1:1:77/xtreme-tumbl-trak-gymnastics-cheer-dance-martial-arts.html) (Year: 2017).*

* cited by examiner

*Primary Examiner* — Jennifer Robertson
*Assistant Examiner* — Catrina A Letterman
(74) *Attorney, Agent, or Firm* — Dale J. Ream

(57) ABSTRACT

A transition trampoline apparatus includes a transition trampoline bed having an elongate configuration that, when mounted on support legs, provides a track for a gymnast that is sufficiently bouncy to ease wear and tear on a gymnast's knees and ankles while not affecting her footwork while running and doing gymnastic maneuvers.

10 Claims, 3 Drawing Sheets

TRANSITION TRAMPOLINE BED

REFERENCE TO RELATED APPLICATIONS

This application claims the benefit of provisional patent application U.S. Ser. No. 62/702,638 filed Jul. 24, 2018 titled Transition Trampoline Bed and which is incorporated in its entirety herein by reference.

BACKGROUND OF THE INVENTION

This invention relates generally to gymnastics devices and, more particularly, to a transition trampoline bed apparatus.

Many gymnastics devices such as trampoline apparatus are preceded by a padded or cloth runway so as to relieve tension and reduce injury on the legs of a gymnast. The bed must be stable and secure against inadvertent movement so as not to create a hazard and cause a gymnast to stumble or to alter her step patterns. The present invention allows for a safer training experience by being able to secure matting to the bed in a manner that the matting will not move around while an athlete tumbles toward it. Also, with the added layer on top of the polypropylene it creates a tighter rebound which makes the transition of a tumbling pass from the transition trampoline to the Gymnastics Floor much easier.

Therefore, it would be desirable to have a transition trampoline bed that, when mounted on support legs, provides a track for a gymnast that is sufficiently bouncy to ease wear and tear on a gymnast's knees and ankles while not affecting her footwork while running and doing gymnastic maneuvers.

SUMMARY OF THE INVENTION

A transition trampoline apparatus according to the present invention includes a bed assembly having a generally elongate and rectangular configuration and constructed of a semi-flexible material that, when supported atop a framework, is suitable for a gymnast to run and perform gymnastic maneuvers on without the associated wear and tear on knees and ankles and the like.

Therefore, it is an object of the present invention to provide a transition trampoline bed that, when mounted on support legs, provides a track portion for a gymnast that is sufficiently resilient to ease wear and tear on a gymnast's knees and ankles while not affecting her footwork while running and doing gymnastic maneuvers.

Figure 1:
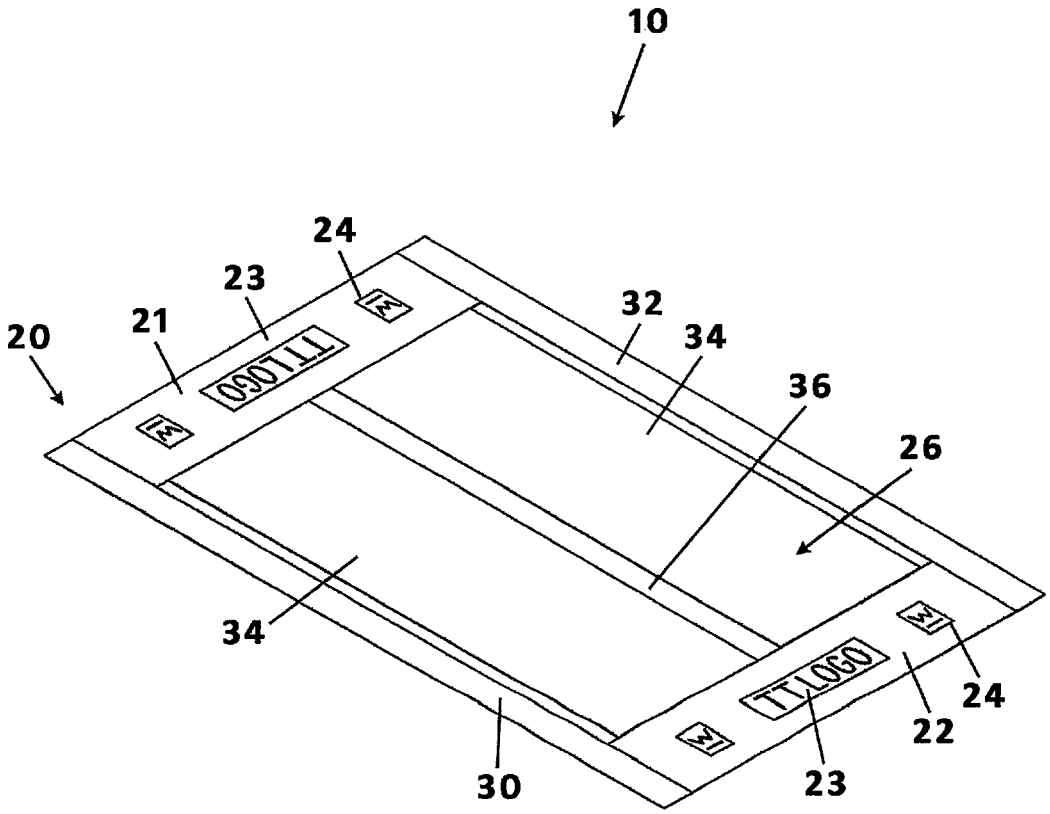
FIG. 1 is a perspective view of a transition trampoline bed according to a preferred embodiment of the present invention.
Figure 2A:
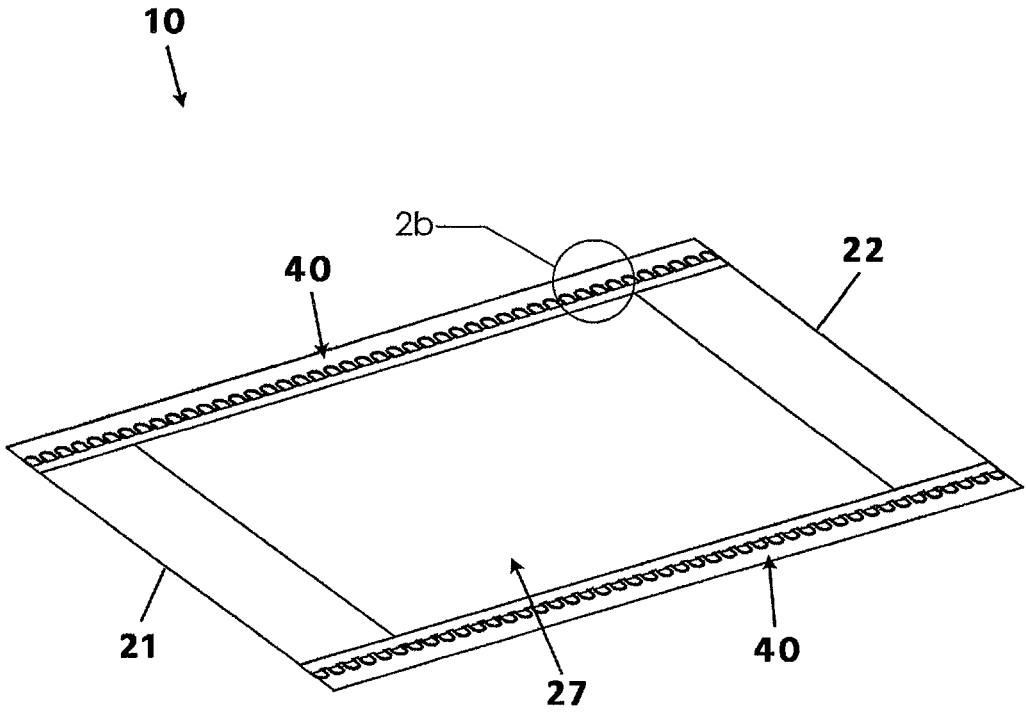
FIG. 2*a* is a perspective view from a bottom perspective angle of the transition trampoline bed as in FIG. 1.
Figure 2B:
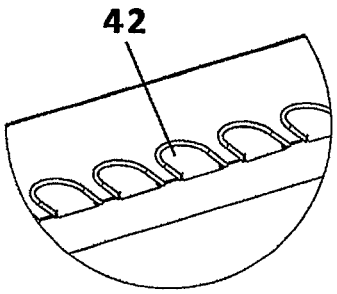
FIG. 2*b* is an isolated view on an enlarged scale taken from FIG. 2*a*.
Figure 3:
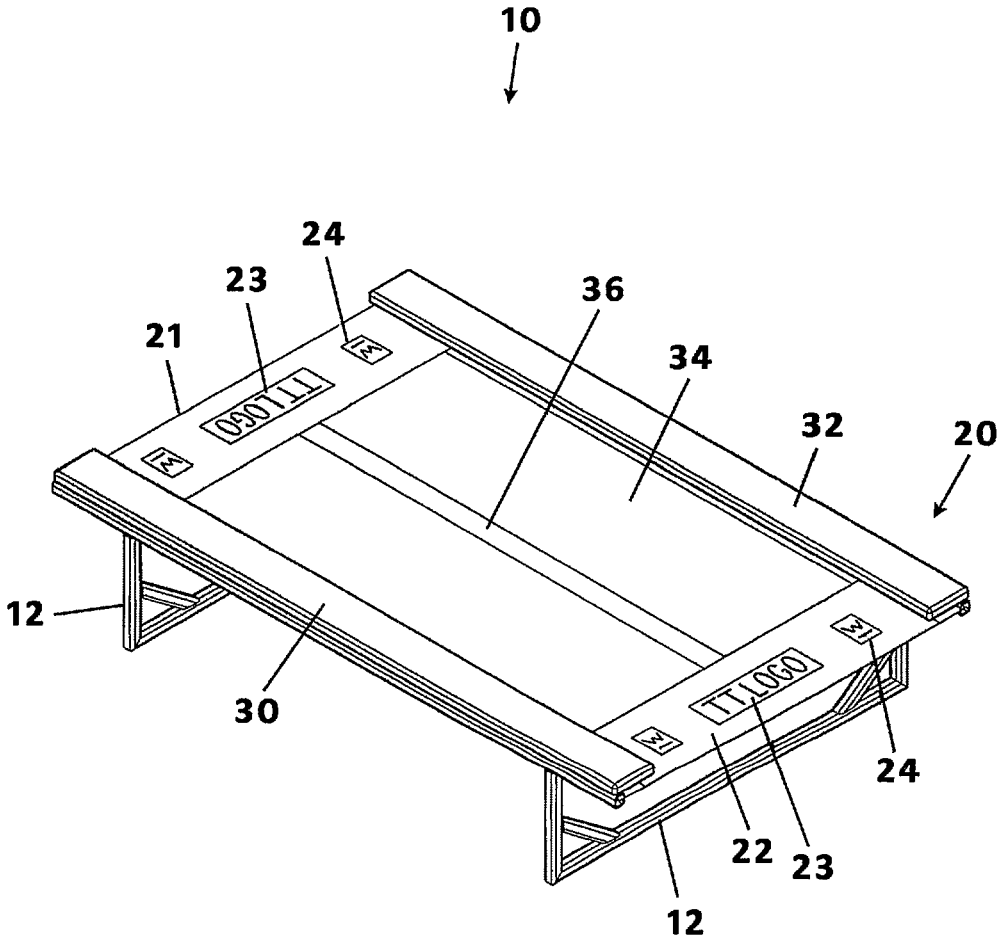
FIG. 3 is a perspective view of the transition trampoline bed as in FIG. 1, illustrated mounted atop support members.

DESCRIPTION OF THE PREFERRED EMBODIMENT a transition trampoline apparatus according to a preferred embodiment of the present invention will now be described with reference to FIGS. 1 to 3 of the accompanying drawings and photographs. The transition trampoline bed apparatus 10 includes a trampling bed assembly 20, a plurality of D-ring fasteners 42, and a pair of opposed strips of loop fasteners suitable for attachment to related gymnastic equipment.

The transition trampoline bed apparatus 10 consists of multiple pieces attached together to create a trampoline bed which may connect to the framework of a trampoline apparatus such as one marketed as T-Trak™ or other gymnastics equipment or otherwise provide a safer training track to practice gymnastic routines that may then be transferred to a less forgiving apparatus, such as a floor routine mat, parallel bars, or the like. The transition trampoline bed apparatus 10 includes a bed assembly 20 and various layers and fasteners that enable use with other gymnastics equipment.

More particularly, the bed assembly 20 is constructed of a semi-flexible material, such as a polypropylene material, that is durable but has resilient or bouncy properties when suspended on spaced apart support members 12. It will be appreciated that each support member 12 may include one or a pair of upstanding legs and a support beam extending between the upstanding legs, the support beam being configured and operable to support the bed assembly 20 thereon. It is understood that a framework of support members 12 shown in the drawings only shows two support members 12, the bed assembly 20 may be longer than shown and many more support members 12 may be incorporated. The bed assembly 20 is the primary and base component of the apparatus 10 and to which all other components are attached. The bed assembly 20 has a generally elongate rectangular configuration and is normally planar or flat. The bed assembly 20, however, is constructed of a semi-flexible material that is selectively rolled out flat for use and rolled up for being stowed or transported. The bed assembly 20 includes a first end 21 and an opposed second end 22, each end including an end panel that may include printed indicia, such as a company logo 23, warning label 24, or the like. In a preferred embodiment, each end panel may measure about 18 inches inward from the end edge, respectively.

The bed assembly 20 has a top side 26 and an opposed bottom side 27 to which other components are attached, such as by sewing or the like. Preferably, the top side 26 includes a layer of hook and loop material and the bottom side 27 include a layer of vinyl material for added durability and strength. The bed assembly 20 has opposed left and right edges that extend longitudinally between the first and second ends, respectively, so as to give the bed assembly 20 peripheral side edges of a rectangular configuration. Further, the bed assembly 20 includes a left section 30 adjacent the left edge and a right section 32 adjacent the right edge and extending between the opposed ends and on the top side 26 of the bed assembly 20. The left and right sections may be referred to as layers and are constructed of loop material suitable to receive corresponding hook material of other exercise equipment. The left section 30 is displaced from the right section 32 by the track portion 34 described below. In other words, the left and right sections do not extend completely between left and right edges but, rather, are separated by the track portion 34 which is sandwiched therebetween. In an embodiment, the vinyl layer described above may be opposite and corresponding to only the left and right sections. In addition, the left section 30 and right section 32 may be constructed to include a red color (color indicia) that may indicate to a gymnast that she is near an edge of the apparatus 10, i.e. that she is not straight.

The track portion 34 is also constructed of hook and loop material and is a portion of the bed assembly 20 intermediate the first and second edges (i.e. side edges) and, more particularly, what is seen in the drawings as that portion of the bed assembly 20 situated between the left and right sections 30, 32, respectively Like the bed assembly 20 as described earlier, the track portion 34 has a planar configuration when the bed assembly 20 is rolled out flat.

Similarly, the bed assembly 20 may include a guide strip 36 extending longitudinally down the center of the track portion 34. Stated another way, the track portion 34 defines a center longitudinal axis along which a narrow white line that is the guide strip 36 is attached. The guide strip 36 may also be constructed of hook and loop material. In use, the guide strip 36 provides a clear intention of a user's direction of running (and perhaps turning flips, cartwheels, and other gymnastics techniques) and may also enhance a user's ability to stay straight.

In another aspect, the transition trampoline bed 10 includes a plurality of fasteners 40 that are configured and operable to attach the transition trampoline bed 10 to other gymnastic equipment and vice versa. Preferably, each fastener of the plurality of fasteners 40 may be a metal D-ring fastener 42 and includes a structure that includes characteristics of making a quick connection. As shown, the plurality of fasteners 40 may be arranged into two lines of adjacent fasteners, the two lines of fasteners being displaced by about 60 inches in an embodiment (FIG. 2). Preferably, each D-ring fastener 42 is positioned about 2.5 inches from an adjacent D-ring fastener 42 such that associated gymnastics equipment of various sizes and configurations may be coupled to the transition trampoline bed apparatus 10. The quantity of rings depends on the length of the bed. Each D-ring fastener 42 may be sewn to the bed assembly along with a portion of nylon webbing.

In yet another aspect, various components of the present invention may include color indicia operable to communicate with a user, i.e. a gymnast, a coach, or a spectator. The colors are not random but rather are intended to convey a corresponding message. For instance, the guide strip 36 may include a white color indicia indicative of a straight (and correct) path down the bed assembly 20. The track portion 34 may include a different indicia, e.g. a blue color indicia, indicative of the acceptable area on which to run or make a tumbling pass. Further, the left section 30 and right section 32 (along opposing peripheral edges) may include still another indicia, such as a red color indicia, indicative of danger or being too near a respective side edge. In other words, the red color is a visual cue to an athlete that she is near an edge of the bed. This helps visually if an athlete tends to tumble toward one side or the other.

In use, the bed assembly 20 may be supported upon the plurality of spaced apart support members 12 so that the bed assembly 20 is allowed to move flexibly as a gymnast runs and does tumbling maneuvers. The resultant flexible and resilient movement eases the fatigue and wear-and-tear on the knees and ankles of the gymnast that would be otherwise experienced on a floor exercise mat, track to a vault, and the like.

It is understood that while certain forms of this invention have been illustrated and described, it is not limited thereto except insofar as such limitations are included in the following claims and allowable functional equivalents thereof.

The invention claimed is:

1. A transition trampoline apparatus for gymnastics and tumbling training, comprising:

a bed assembly having a first end and a second end opposite said first end and having a left edge and a right edge extending peripherally between said first and second ends, respectively, and including a track portion having a planar configuration extending between and bounded by said first and second ends and said left and right edges, said bed assembly including a top side and a bottom side opposite said top side, said bed assembly having a planar configuration and being constructed of a semi-flexible material;

a left section constructed of a loop fastening material attached to and extending longitudinally atop said top side of said bed assembly adjacent said left edge of said bed assembly;

a right section constructed of a loop fastening material attached to and extending longitudinally atop said top side of said bed assembly adjacent said right edge of said bed assembly;

a plurality of fasteners attached to said bottom side and spaced apart from one another; and a guide strip attached to and extending longitudinally along a center axis of said track portion of said bed assembly between said first and second ends, said guide strip being indicative of a correct direction in use;

wherein:

said track portion is constructed of hook and loop material having a first color;

said left section and said right section include a second color different than said first color;

said guide strip includes a third color different than said first and second colors.

2. The transition trampoline apparatus as in claim 1, further comprising a framework having a plurality of support members spaced apart from one another and operatively configured to support said bed assembly.

3. The transition trampoline apparatus as in claim 1, wherein said semi-flexible material of said bed assembly is polypropylene.

4. The transition trampoline apparatus as in claim 1, wherein each fastener of said plurality of fasteners is a metal D-ring.

5. The transition trampoline apparatus as in claim 4, wherein each D-ring is coupled to said bottom side of said bed assembly.

6. The transition trampoline apparatus as in claim 1, wherein said bed assembly is flexibly movable by rolling between a flat configuration for use and a rolled up configuration for stowing or transport.

7. A transition trampoline apparatus for gymnastics and tumbling training, comprising:

a bed assembly having an elongate and rectangular configuration constructed of a polypropylene material that is semi-rigid and yet resilient, said bed assembly having a first end and a second end opposite said first end and having a left edge and a right edge extending peripherally between said first and second ends, respectively, and including a track portion having a planar configuration extending between and bounded by said first and second ends and said left and right edges, said bed assembly including:

a top side and a bottom side opposite said top side;

a left section constructed of a loop fastening material attached to and extending longitudinally atop said top side of said bed assembly adjacent said left edge of said bed assembly;

a right section constructed of a loop fastening material attached to and extending longitudinally atop said top side of said bed assembly adjacent said right edge of said bed assembly;

a plurality of D-ring fasteners attached to said bottom side and spaced apart from one another; and a guide strip attached to and extending longitudinally between said first and second ends along a center axis of said track portion of said bed assembly, said guide strip being indicative of a correct direction in use;

wherein:

said track portion is constructed of hook and loop material having a first color;

said left section and said right section include a second color different than said first color;

said guide strip includes a third color different than said first and second colors.

8. The transition trampoline apparatus as in claim 7, further comprising a framework having a plurality of support members spaced apart from one another.

9. The transition trampoline apparatus as in claim 7, wherein each of the plurality of D-ring fasteners is coupled to said bottom side of said bed assembly.

10. The transition trampoline apparatus as in claim 7, wherein said bed assembly is movable between a flat configuration for use and a rolled up configuration for stowing or transport.

* * * * *